US007296912B2

(12) United States Patent
Beauchamp

(10) Patent No.: US 7,296,912 B2
(45) Date of Patent: Nov. 20, 2007

(54) LED LIGHT BAR ASSEMBLY

(76) Inventor: Pierre J Beauchamp, 80, rue Palardy, Laprairie, Quebec (CA) J5R 5V8

( * ) Notice: Subject to any disclaimer, the term of this patent is extended or adjusted under 35 U.S.C. 154(b) by 113 days.

(21) Appl. No.: 11/231,818

(22) Filed: Sep. 22, 2005

(65) Prior Publication Data

US 2007/0064428 A1 Mar. 22, 2007

(51) Int. Cl.
*F21V 21/00* (2006.01)

(52) U.S. Cl. ..... 362/249; 362/800; 362/227

(58) Field of Classification Search ..... 362/800, 362/249, 294, 373, 227
See application file for complete search history.

(56) References Cited

U.S. PATENT DOCUMENTS 6,158,882 A * 12/2000 Bischoff, Jr. ..... 362/488
6,354,714 B1 * 3/2002 Rhodes ..... 362/153.1
6,578,986 B2 * 6/2003 Swaris et al. ..... 362/249
6,682,205 B2 * 1/2004 Lin ..... 362/249
6,846,093 B2 * 1/2005 Swaris et al. ..... 362/249
6,851,832 B2 * 2/2005 Tieszen ..... 362/249

* cited by examiner

*Primary Examiner*—Anabel Ton
(74) *Attorney, Agent, or Firm*—Ogilvy Renault LLP

(57) ABSTRACT

An LED (light emitting diode) light bar assembly is comprised of an elongated casing having an elongated cavity of substantially U-shape cross-section. The casing has a base wall, opposed side walls and an elongated open end between the side walls. One or more elongated heat sink LED modules each having two or more LEDs and electrical component parts thereof are retained in each of the modules. The LEDs are exposed in a spaced-apart relationship in a common wall of the modules. The casing is configured to removably receive and retain one or more of the modules therein in end-to-end relationship. The casing defines in combination with the one or more modules, at least one internal channel for the passage of wiring which is non-visible exteriorly of the module. At least one end connector is detachably securable to an end of the casing for securing the casing to a support structure. The connector has an internal passage for receiving wiring from the modules retained in the casing.

15 Claims, 4 Drawing Sheets

LED LIGHT BAR ASSEMBLY

TECHNICAL FIELD

The present invention relates to an LED (light emitting diode) light bar assembly of miniature size and comprised essentially of an elongated casing in which are removably retained one or more elongated LED modules with the assembly being connectable to a support structure by at least one end connector. Preferably, but not exclusively, the light bar assembly is used in articles of furniture to provide a source of lighting which can easily be concealed.

BACKGROUND ART

Lighting systems used in articles of furniture such as display cases for jewelers, kitchen cabinets, gazebos and like applications where it is important to conceal the lights, utilize two common sources of lighting, namely fluorescent and halogen light sources. However, these light sources have many disadvantages when used in these applications. For example, when using fluorescent lighting, such usually requires additional wiring to bring in the standard 110 volt A.C. supply. It is also necessary when using fluorescent lamps to install a lamp housing provided with supports which secure to opposed ends of the lamp and which are connected to the electrical supply through a ballast. The wiring is concealed in the casing. With these constraints, it is often difficult to conceal fluorescent lamps.

Another disadvantage of fluorescent lamps is that although they come in different lengths, the shorter the lamp, the lower is the lumen. It is therefore difficult to use these lamps when a certain lumen is required and the mounting space is restricted. Also, if two or more tubes are used, then dark spots will result between the zones between the fluorescent tubes. These dark spots are the result of the size of the housings whereby when installed end-to-end, there will be dark spots between each of the fluorescent tubes due to the spacing therebetween.

Another type of lighting used in such applications is halogen lighting which also has disadvantages but different from those of fluorescent tubes. The major disadvantage of halogen lamps is that they generate heat. Accordingly, if these lamps are used in a constrained space, this heat needs to be taken into consideration as it could be damaging. However, the lighting produced by halogen lights is excellent.

Another disadvantage of halogen lamps is that they have a relatively short life. If these lamps are used in display cases, the heat can damage the articles being displayed. It is estimated that ninety percent (90%) of the power of these halogen lamps is transformed into heat. Accordingly, these inconveniences limit the application of these lamps and they are mostly utilized in encapsulated housings mounted in ceilings of building structures and exposed to open spaces. These encapsulated halogen lamps can be used in furniture cabinets provided that there are no products exposed to the lighting within ten inches thereof as the heat generated thereby will often cause discoloration of the articles. They are also not recommended for use in enclosed display cases for jewelers as this heat will affect the lubricants in watches, for example. Also because these lamps need to be periodically changed, they cause an inconvenience. Still further, due to their sizes, they are difficult to conceal.

SUMMARY OF INVENTION

It is a feature of the present invention to provide a lighting system for use in the above-mentioned applications and which does not generate intense heat and which provides a strong intensity of illumination.

Another feature of the present invention is to provide an LED (light emitting diode) light bar assembly which is miniature in size and which can easily be concealed.

Another feature of the present invention is to provide an LED (light emitting diode) light bar assembly which is easy to assemble and secure and wherein the light bulbs have a long life.

Another feature of the present invention is to provide an LED (light emitting diode) light bar assembly which is aesthetically pleasing, which has flexibility in that it can be provided in different lengths and which can be utilized in enclosed areas such as display cases.

Another feature of the present invention is to provide an LED (light emitting diode) light bar assembly wherein the wiring and the supply of the light bar assembly is not visible.

Another feature of the present invention is to provide an LED (light emitting diode) light bar assembly which is easy to orient to direct the light beam at a desired location.

Another feature of the present invention is to provide an LED (light emitting diode) light bar assembly which incorporates a heat sink or cooling system.

According to the above features, from a broad aspect, the present invention provides an LED light emitting diode) light bar assembly comprised of an elongated casing having an elongated cavity of U-shape cross-section which defines a base wall, opposed side walls and an elongated open end between the side walls. One or more elongated heat sink LED modules each having two or more LEDs and electrical component parts thereof are retained in each of the modules. The LEDs are exposed in a spaced-apart relationship in a common wall of the modules. The casing is configured to removably receive and retain one or more of the modules therein in end-to-end relationship. The casing defines in combination with the one or more modules, at least one internal channel for the passage of wiring which is non-visible exteriorly of the module. At least one end connector is detachably securable to an end of the casing for securing the casing to a support structure. The connector has an internal passage for receiving wiring from the modules retained in the casing. The modules are each provided with cavities at opposed ends thereof and leading to the side walls for the passage of electrical wires. The modules are retained in end-to-end relationship in the casing cavity with the wires disposed in the internal channels. The end connector has a hollow connecting hub dimensioned and configured for frictional sliding fit at a connecting end in a space adjacent a free end of the casing cavity. The wires are received and concealed in the hollow connecting hub which constitutes the internal passage. Connecting means is further provided for securing the connector to the support structure.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
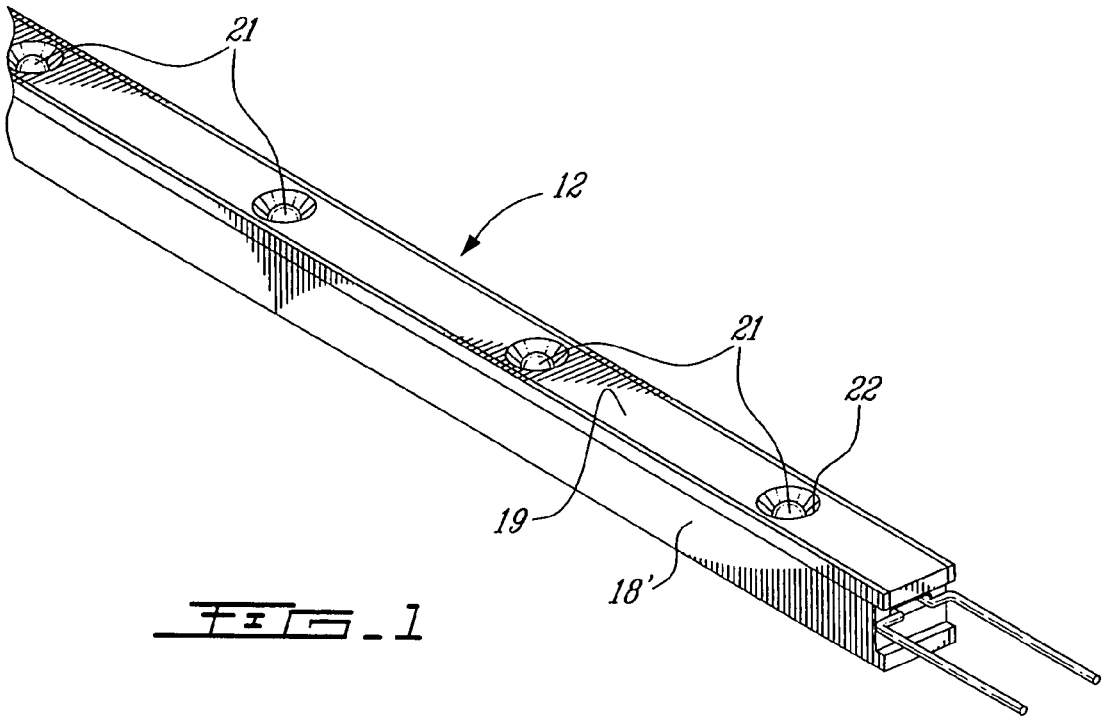
FIG. 1 is a perspective view of an elongated heat sink LED module.
Figure 2:
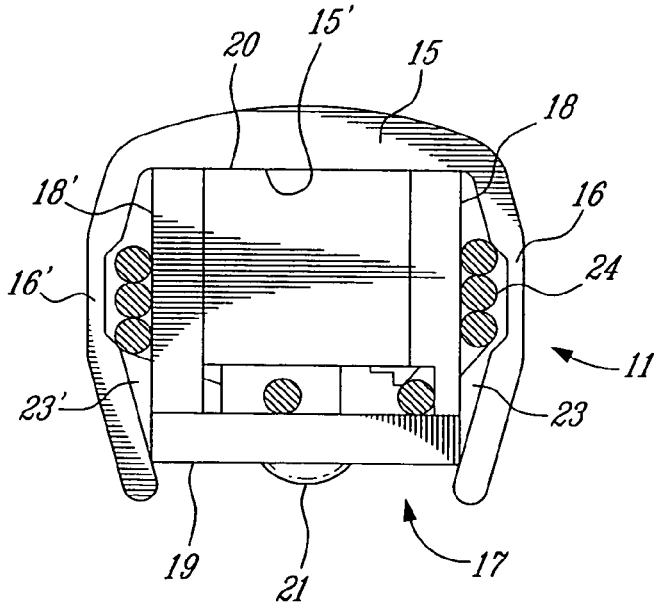
FIG. 2 is a cross-section view illustrating the assembly of an LED modules in an elongated casing.
Figure 3:
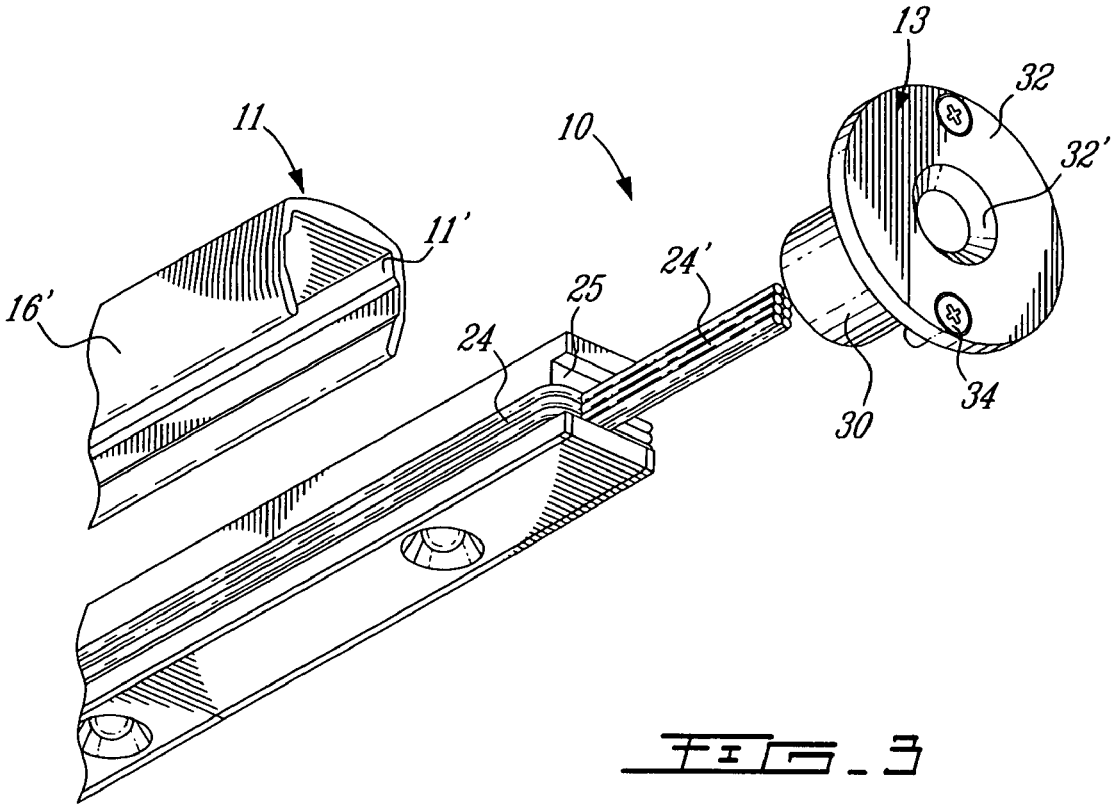
FIG. 3 is an exploded view, partly fragmented, showing the component parts of the assembly with the wiring of the modules and an end connector.
Figure 4:
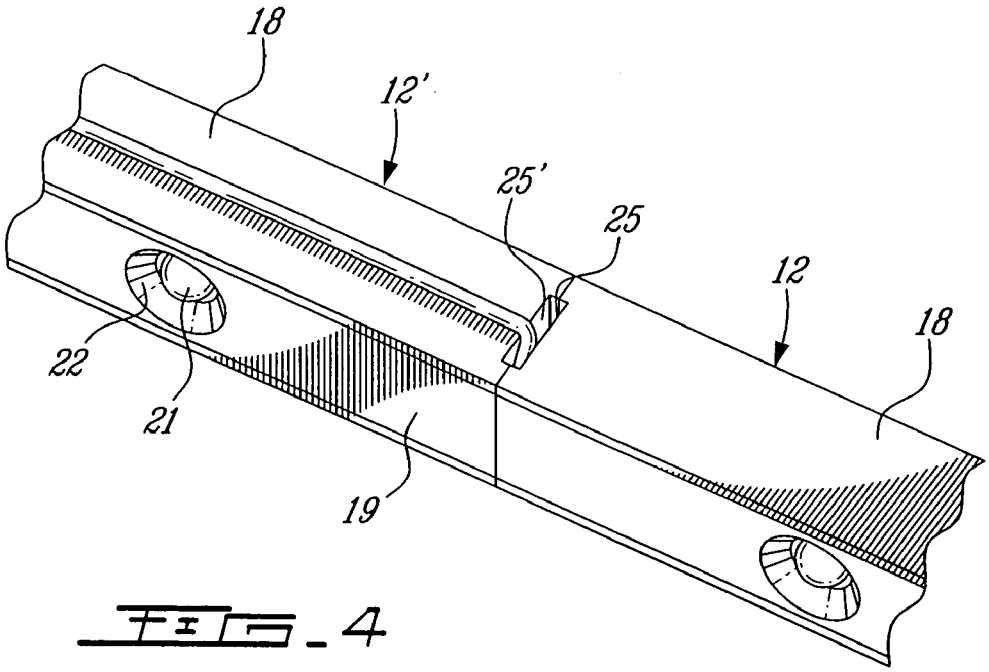
FIG. 4 is an enlarged fragmented perspective view showing two modules connected end-to-end.
Figure 5:
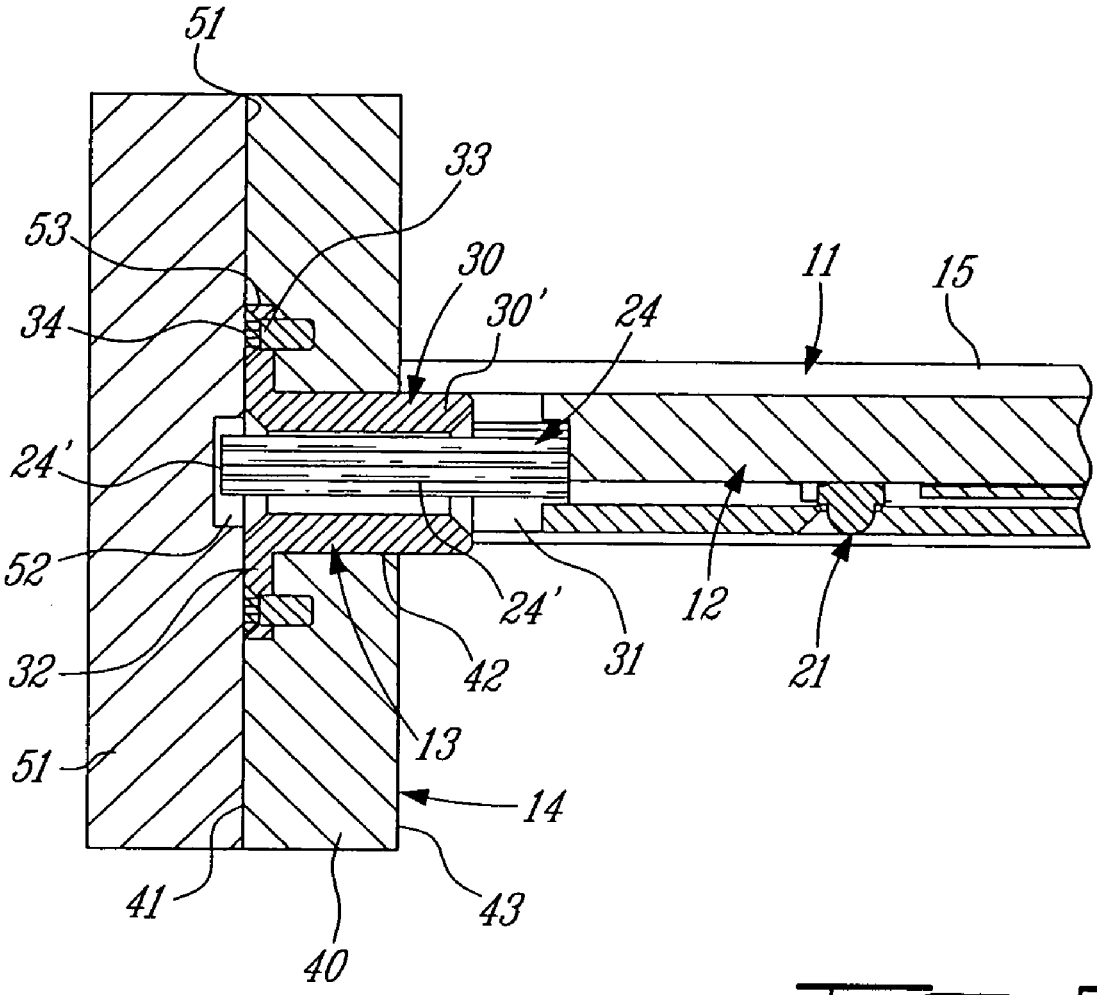
FIG. 5 is a section view showing the LED light bar assembly of the present invention secured in a support structure comprised of two vertical wall boards.

Referring now to the drawings and more particularly to FIGS. 1 to 5, there is shown generally at 10 in FIG. 3, the LED (light emitting diode) light bar assembly of the present invention. It is constituted by an elongated casing 11 which may be extruded from aluminum material or which may be formed of plastics, either extruded or molded, and in which there is slidingly retained one or more elongated heat sink LED modules 12, as shown in FIG. 1. The light bar assembly also comprises at least one end connector 13 which is detachably securable to an end of the casing 11 for securing the casing to a support structure 14, such as illustrated in FIG. 5, although it can be secured to various other types of support structures.

As shown in FIGS. 2 and 3, the elongated casing 11 has an elongated cavity 11' which is substantially U-shaped in cross-section and defines a base wall 15, opposed side walls 16 and 16' and an elongated open end 17. The side walls 16 and 16' are inwardly curved side walls for reason as will be described later. The outer appearance of the casing may have different shapes.

The modules 12 are substantially rectangular or square in cross-section and define opposed parallel flat side walls 18 and 18', a bottom wall 19 and a top wall 20. Two or more LEDs, herein four LEDs 21 project in cavities 22 provided in the bottom wall 19. Electrical connections or component parts to these LEDs are concealed within the modules 12 and such does not form part of the present invention. These LEDs are white light lamps which are exposed in a spaced apart relationship in this bottom wall 19.

As shown in FIG. 2, the modules 12 are disposed in sliding fit within the casing 11 and cavity 11' and because the side walls 16 and 16' of the casing are curved side walls, they define a pair of internal channels 23 and 23' to accommodate the passage of the wiring 24 which connects to the LEDs of each module retained within the casing 11. Accordingly, this wiring 24 is not visible from the exterior of the light bar assembly 10.

As also shown in FIG. 2, the top wall 20 of the modules is a flat top wall and is disposed in contact with the flat inner surface 15' of the base wall 15 to provide for heat conduction therewith. Accordingly, heat is dissipated through the casing 11. As well, heat is dissipated through the channels and the connectors, and the exposed bottom wall 19, as will be described later. It is also conceivable that all of the wiring could be run through a single one of the channels and that the inner face of one of the side walls 16 or 16' have a flat surface in contact with a side wall of the module to provide improved thermal conductivity therewith.

As shown in FIG. 4, each of the modules, herein modules 12 and 12', are provided with cavities 25 and 25', respectively, at their opposed ends and through their side walls 18 and 18' for the passage of electrical wires 24 as better illustrated in FIG. 3, when these modules are connected in end-to-end facial contact in the casing 11.

Referring now more specifically to FIGS. 3 and 5, there is shown the construction of the end connector 12. As hereinshown the end connector has a hollow connecting hub 30 which is dimensioned and configured for frictional sliding friction fit at a connecting end 30' thereof (see FIG. 5) into a space 31 of the cavity 11', adjacent a free end of the casing 15. The wire bundle 24', as shown in these Figures, is received and concealed in the hollow connecting hub 30 which hub constitutes an internal passage for such wiring. A connecting means in the form of a transverse connecting flange 32 formed integral with the hub at a free end thereof is provided for securing the connector to support means such as a vertical wall, etc. The connecting flange 32 is provided with holes 33 whereby to receive fasteners 34 therein to achieve this fastening.

As shown in FIG. 5, the support structure is herein constituted by a vertical wall board 40 or board section with the connecting flange 32 secured to an internal surface 41 of the wall board 40 and with the hollow connecting hub 30 extending through a mounting hole 42 in the board 40 and protruding from the opposed surface 43 of the board 40 whereby to expose the connecting end 30' thereof for connection within a free end section of the casing 11. As hereinshown, the wire bundle 24' extends through the hollow hub 30 and behind the internal surface 41 of the vertical wall board. Of course, this vertical wall board can be a kitchen cabinet with the light bar assembly 10 extending therefrom. The wires would then run in one of the cupboards of the cabinet where a transformer can be concealed. There are several other ways in which this light bar can be connected. The connector 30 may be provided at one end only of the assembly 10 with the other end being fitted with a plug (not shown) with the bars supported freely from a support wall such as the vertical wall board 40. Alternatively, the assembly may be suspended, if it is a long assembly, by wires extending from a ceiling or from any wall above the elongated light bar assembly which may be several feet in length. The miniature casing of the present invention is approximately ¼ inch in cross-section.

Figure 6:
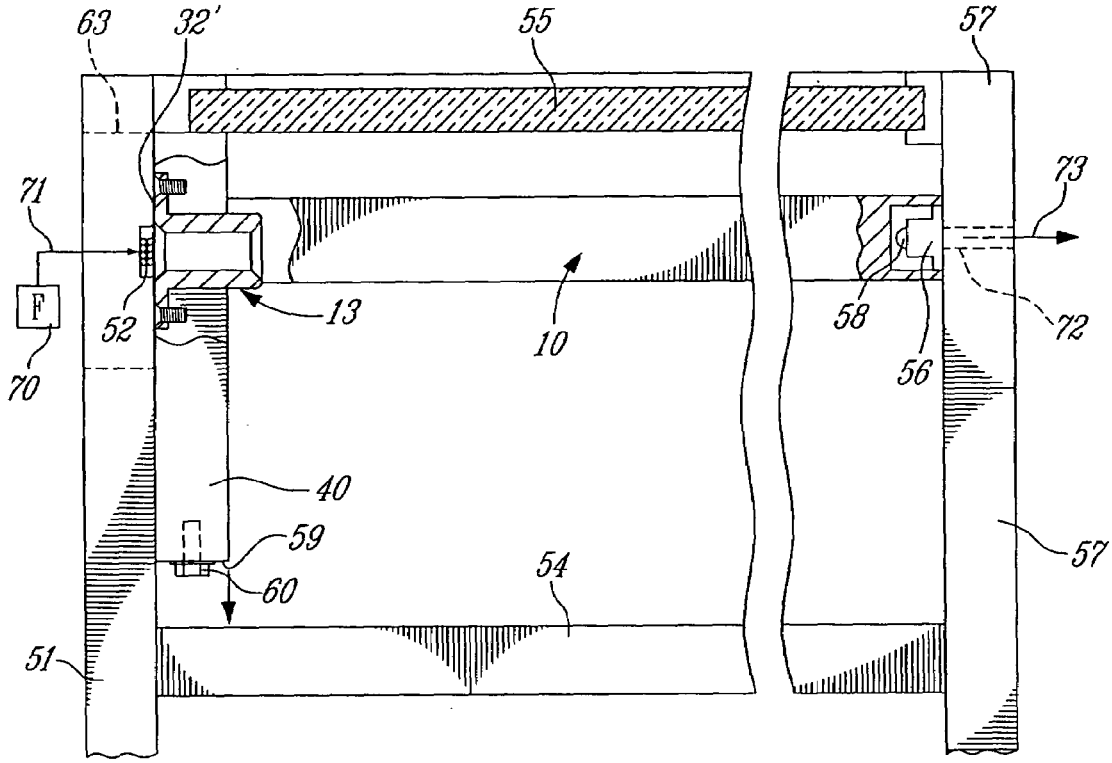
FIG. 6 is a schematic section view showing the construction of a display case incorporating therein the miniature LED light bar assembly of the present invention and wherein the light bar can also be cooled by generating an air current therethrough.

With further reference to FIGS. 5, 6, 7A and 7B, there will be described the specific application or use of the light bar assembly. As hereinshown, the vertical wall board 40 is that as used in the construction of a display case 50 as illustrated in FIG. 6. A second exterior wall board 51 is provided and against which the wall board 40 is secured. A channel 52 is routed in this second exterior wall board 51 adjacent to the hub of the connector 13 for the passage of the wire bundle 24' therethrough. As hereinshown, the flange 32 of the connector is also mounted in a routed cavity 53 so that it is flush with the inner surface 51' of the second wall board 51. Accordingly, the wiring is concealed in a composite wall panel of the display case 50.

As shown in FIG. 6, the display case has a bottom wall 54 and a glass top wall 55 and front wall (the latter not being shown herein). One end of the light bar assembly 10 is supported by the connector 13 and the other end may be supported by a support disc 56 which is secured to the opposed vertical wall 57 by means of a screw fastener 58.

Figure 7A:
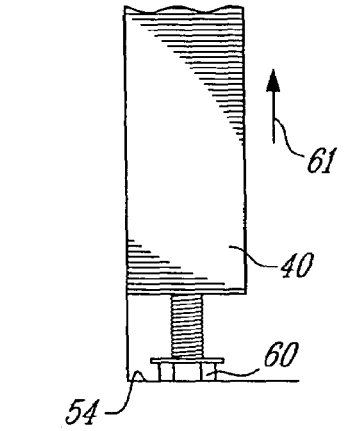
FIG. 7A is a fragmented schematic view showing an interior wall board of the display case of FIG. 6 in an engaged position.
Figure 7B:
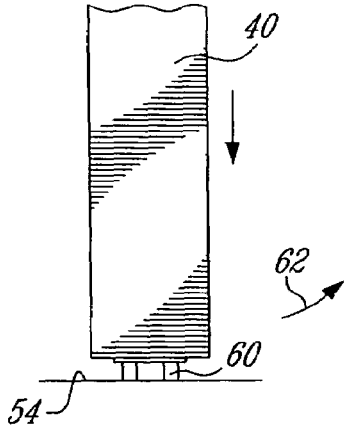
FIG. 7B is a view similar to FIG. 7A showing the interior wall board in a disengaged position whereby to remove the light bar assembly.

The vertical wall board 40, or board section, as hereinshown has a flat bottom wall 59 which is provided with one or more support threaded bolts 60 which provide for vertical wedging displacement of the wall board 40. It also provides for the removal of the vertical wall board or section and the light bar assembly 10. Such is illustrated in FIGS. 7A and 7B. As shown in FIG. 7A, when the threaded bolt 60 is threaded outwardly, it wedges the wall board 40 or section upwardly in the direction of arrow 61 placing it in the position as illustrated in FIG. 6. When the bolt 60 is threaded in, as illustrated in FIG. 7B, the vertical wall board 40 or board section can be lowered a limited amount sufficient to cause it to tilt outwardly in the direction of arrow 62 to disengage the light bar assembly. Of course, in doing so it is necessary to pull on the wire bundle 24'.

Alternatively, the vertical wall board 40 or board section may extend to the base wall 54 and an exterior board piece 63 inserted adjacent the connector 13 in the exterior wall 51 may be removable whereby to provide access to the connector 13 for the removal thereof. These illustrated attachments of the connector only illustrate a few examples of attachment and many other configurations of connections are possible and it is not intended to restrict the present invention to the attachments as herein illustrated.

Another important advantage of the connector 13 is that it permits for the casing and its LED modules to be rotated about the support axis of these connectors whereby to orient the light beams of the LED or the bottom wall 19 of the modules at a specific angle. This is particularly useful when the light bar is used in a display case, as illustrated in FIG. 6 or in other applications where it is required to orient the light beam at a specific angle or to change the angle of the light beam from time-to-time depending on its intended use.

With further reference to FIG. 6 there is also shown that an air cooling current could be directed through the light bar assembly by providing a concealed fan 70 with a conduit 71 extending to the open end 32' of the connector 13 or to the channel 52 formed in the support wall 51. The other end of the assembly may have a hole 72 whereby to evacuate air as illustrated by arrow 73. Accordingly, this small fan would generate a continuous airflow through the channels 23 and 23' and thereby continuously cooling the modules 12 and the casing 11. Because the system of the present invention is a modular system, this may be desirable when the light bar assembly is of a very long length and used in a restricted space. It is also pointed out that the connectors 13 may be provided at opposed ends of the casing and each be connected in a terminal box which is hung from a ceiling by a tube and in which one of the tubes would accommodate the wire bundle. Accordingly, the assembly can be either connected to a wall or suspended from a ceiling depending on the application thereof.

It is within the ambit of the present invention to cover any obvious modifications of the preferred embodiment described herein, provided such modifications fall within the scope of the appended claims.

The invention claimed is:

1. An LED (light emitting diode) light bar assembly comprising an elongated, easing having an elongated cavity of substantially U-shape cross-section defining a base wall, opposed side walls and an elongated open end between said side walls; one or more elongated heat sink LED modules each having two or more LEDs and electrical component parts thereof retained in each said module, said LEDs being exposed in a spaced-apart relationship in a common wall of said modules, said easing being configured to removably receive and retain one or more of said modules therein in end-to-end relationship, said casing defining in combination with said one or more modules at least one internal channel for the passage of wiring which is non-visible exteriorly of said module, at least one end connector detachably securable to an end of said casing for securing said casing to a support structure and having an internal passage for receiving wiring from said modules retained in said casing, said modules being each provided with cavities at opposed ends thereof and leading to said side walls thereof for the passage of electrical wires, said modules being retained in end-to-end relationship in said casing cavity with said wires disposed in said internal channels, said end connector having a hollow connecting hub dimensioned and configured for frictional sliding fit at a connecting end in a space adjacent a free end of said casing cavity, said wires being received and concealed in said hollow connecting hub which constitutes said internal passage, and connecting means for securing said connector to said support structure.

2. An LED light bar assembly as claimed in claim 1 wherein said casing is a metal heat sink housing.

3. An LED light bar assembly as claimed in claim 2 wherein said opposed side walls are inwardly curved side walls, said modules having opposed parallel flat side walls, said common wall being a flat wall disposed adjacent said open end of said casing, there being two of said internal channels, one defined on opposed sides of said modules between said opposed parallel flat side walls and an inner face of said opposed side walls of said casing.

4. An LED light bar assembly as claimed in claim 3 wherein said base wall is a flat base wall, said module having a flat top wall opposed to said common wall and extending parallel thereto said flat top wall being retained in contact with said flat base wall for thermal conduction therewith.

5. An LED light bar assembly as claimed in claim 1 wherein said connecting means is a transverse connecting flange at a free end of said hollow connecting hub, said flange having holes therein to receive fasteners.

6. An LED light bar assembly as claimed in claim 1 wherein said support structure is constituted by a vertical wall board, said flange being secured to an internal surface of said wall board with said hollow connecting hub extending through a mounting hole in said wall board and having said connecting end protruding beyond an outer surface of said wall board whereby to retain said free end of said casing adjacent said outer surface with said wires being non-visible.

7. An LED light bar assembly as claimed in claim 6 wherein said vertical, wall board is part of an end wall of a display case, and a second exterior wall board secured to said internal surface of said wall board and having a channel therein for the passage of said wires, said flange being concealed between said wall boards.

8. An LED light bar assembly as claimed in claim 7 wherein said vertical wall board is removably secured adjacent said second exterior wall board.

9. An LED light bar assembly as claimed in claim 8 wherein said vertical wall board has a flat bottom wall, one or more support threaded bolts in said bottom wall for vertical wedging displacement and removal of said vertical wall board and said light bar assembly.

10. An LED light bar assembly as claimed in claim 9 wherein there is provided a further end connector at an opposed free end of said casing for support engagement against an opposed vertical wall of said display case.

11. An LED light bar assembly as claimed in claim 1 wherein said light bar is a miniature light bar having an overall transverse dimension of about ¾ inch.

12. An LED light bar assembly as claimed in claim 1 wherein said elongated casing is an aluminum extruded casing.

13. An LED light bar assembly as claimed in claim 10 wherein said casing with said LED modules is rotatable between said end connectors to orient the direction of light emitted by said LED's.

14. An LED light bar assembly as claimed in claim 10 wherein a forced air supply is connected across said end connector to generate a cooling air current through said internal channels to cool said LED modules.

15. An LED light bar assembly as claimed in claim 1 wherein said LEDs are white light LED lamps.

* * * * *